US009543633B2

(12) United States Patent
Jones

(10) Patent No.: US 9,543,633 B2
(45) Date of Patent: Jan. 10, 2017

(54) ANTENNA DISH HEATING SYSTEM

(75) Inventor: Thaddeus M. Jones, Bremen, IN (US)

(73) Assignee: MSX, Incorporated, South Bend, IN (US)

( * ) Notice: Subject to any disclaimer, the term of this patent is extended or adjusted under 35 U.S.C. 154(b) by 2071 days.

(21) Appl. No.: 12/708,851

(22) Filed: Feb. 19, 2010

(65) Prior Publication Data

US 2011/0205131 A1 Aug. 25, 2011

(51) Int. Cl.
*H01Q 1/02* (2006.01)
*H01Q 15/16* (2006.01)

(52) U.S. Cl.
CPC ..... *H01Q 1/02* (2013.01); *H01Q 15/16* (2013.01)

(58) Field of Classification Search
CPC ..... H01Q 1/02; H01Q 1/1278; H01Q 1/1271; H01Q 19/0407
USPC ..... 343/704, 904
See application file for complete search history.

(56) References Cited

U.S. PATENT DOCUMENTS

| | | | | |
|---|---|---|---|---|
| 5,963,171 | A * | 10/1999 | Jones | 343/704 |
| 6,195,055 | B1 * | 2/2001 | Jones | 343/704 |
| 7,324,067 | B2 * | 1/2008 | Shen | 343/912 |
| 2006/0250313 | A1 * | 11/2006 | Greenleaf et al. | 343/704 |

* cited by examiner

*Primary Examiner* — Dameon E Levi
*Assistant Examiner* — Collin Dawkins
(74) *Attorney, Agent, or Firm* — Taylor IP, P.C.

(57) ABSTRACT

An antenna system having a dish, a heating element and a shaped plate. The dish has a concave shape on one side and a generally convex shape on the opposite side. The shaped plate has the heating element applied to a first side. The shaped plate has a second opposite side. The shaped plate is coupled to the opposite side of the dish. The shaped plate being formed from a flat plate having at least one slot cut therein, each slot having edges that are overlapped to thereby cause the flat plate to become the shaped plate.

20 Claims, 4 Drawing Sheets

ANTENNA DISH HEATING SYSTEM

BACKGROUND OF THE INVENTION

The invention relates to an antenna heater, and more particularly to a heater system for a dish antenna.

DESCRIPTION OF THE RELATED ART

In inclement weather, icing of antennas is known to have destructive consequences caused by the weight of the ice. This is sometimes overcome by shielding the antenna or erecting an antenna only when a signal use of the antenna is anticipated. Icing can also degrade signals by distorting the path of the signal and reduce the overall effectiveness of the antenna system.

It is known to place a cover over the convex portion of the dish to reduce the amount of moisture that may accumulate on the reflective surface of the dish. This method has negative aspects, such as the cover leads to some attenuation of the signal and also provides a different surface for the ice to accumulate thereon.

Another attempted solution is to apply a heating element directly to the surface of the dish, either on the front or back surface, to provide conductive heat to reduce the effect of the ice or snow buildup on the dish. This has disadvantages in that it depends upon the thermal conductivity of the dish itself to transfer the heat uniformly across the dish surface. The thermal path can be interrupted by ribs along the back of the dish that are provided for structural rigidity of the dish, which can prevent a uniform application of the heating element.

What is needed in the art is an economical method and apparatus in which the surface of an antenna dish can be uniformly heated.

SUMMARY OF THE INVENTION

The present invention, in one form thereof, is an antenna system having a dish, a heating element and a shaped plate. The dish has a concave shape on one side and a generally convex shape on the opposite side. The shaped plate has the heating element applied to a first side. The shaped plate has a second opposite side. The shaped plate is coupled to the opposite side of the dish. The shaped plate being formed from a flat plate having at least one slot cut therein, each slot having edges that are overlapped to thereby cause the flat plate to become the shaped plate.

Another form of the present invention includes a method of heating an antenna dish, including the steps of applying a heating element and coupling that shaped plate to the dish. The applying step includes applying a heating element to a first side of a shaped plate, the shaped plate having an opposite second side. The coupling step includes coupling the shaped plate to a dish having a concave shape on one side and a generally convex shape on an opposite side, the shaped plate being positioned on the opposite side of the dish. The shaped plate being formed from a flat plate having at least one slot cut therein, each slot having edges that are overlapped to thereby cause the flat plate to become the shaped plate.

The present invention advantageously provides convective heat in a more uniform manner than in prior art.

Another advantage of the present invention is that it can be applied to an antenna dish that has ribs extending therefrom.

Another advantage of the present invention is that the shaped plate is made from a flat plate having slots cut therein and overlapped.

Yet another advantage of the present invention is that the plate can be shaped on site to largely conform to the shape of the antenna dish.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one embodiment of the invention, in one form, and such exemplifications are not to be construed as limiting the scope of the invention in any manner.

DETAILED DESCRIPTION OF THE INVENTION

Figure 1:
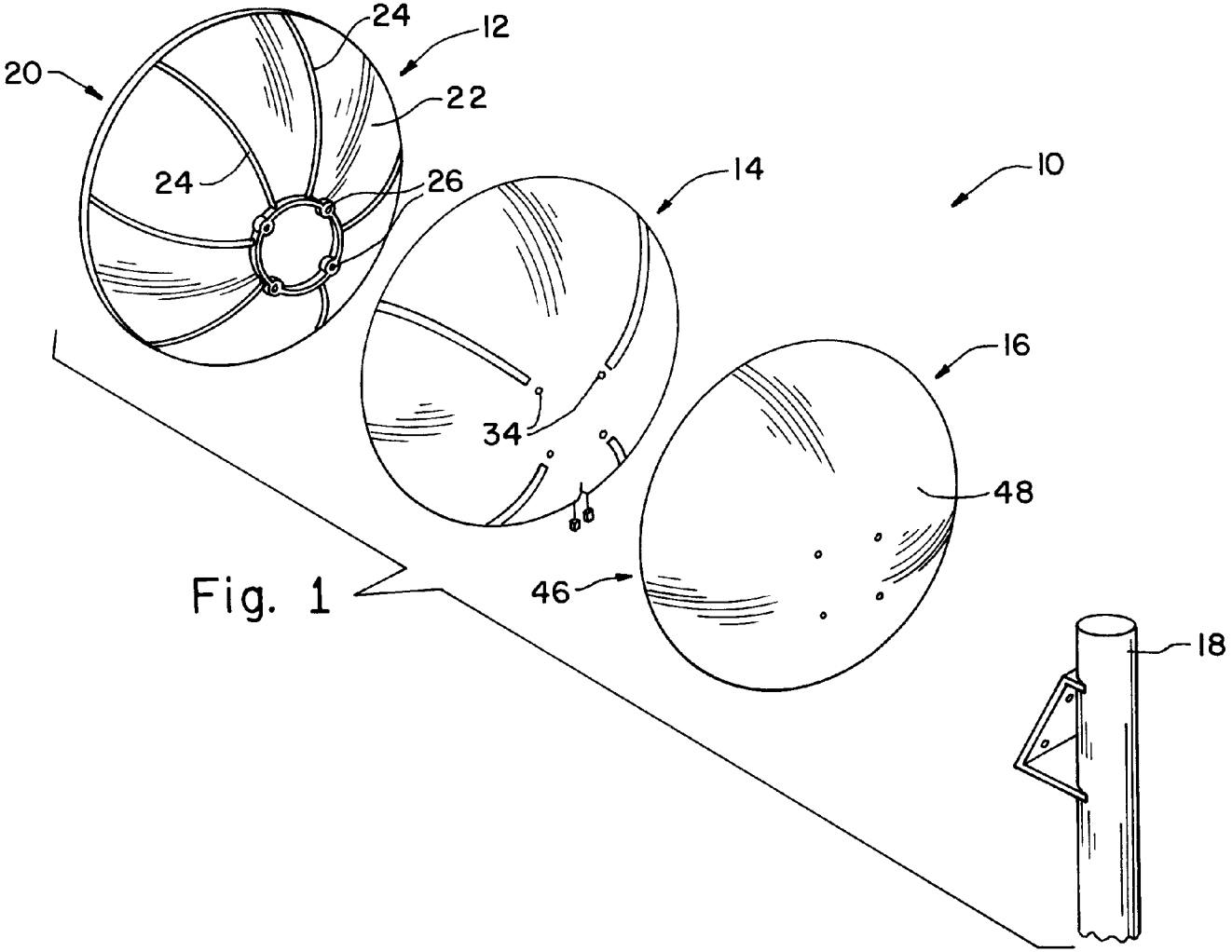
FIG. 1 is an exploded perspective view of an antenna system utilizing an embodiment of the heating system of the present invention.

Referring now to the drawings, and more particularly to FIGS. 1-5, there is shown an antenna system 10 including a dish 12, a shaped plate 14, an insulating layer 16 and a mounting post 18. Antenna system 10 would include a receiver/transmitter section, which is not shown for purposes of clarity and ease of explanation of the present invention. Dish 12 has a concave side 20, a convex side 22, ribs 24 and threaded studs 26. Dish 12 has an off-center parabolic shape. Concave side 20 is generally carefully shaped to properly reflect incoming and outgoing radio frequency signals directed from a feedhorn or waveguide assembly to then focus or distribute the signal as dictated by the shape of concave side 20. Convex side 22 may largely follow the shape of concave side 20 in an opposite sense but may be thicker in certain sections to provide rigidity to dish 12. Another factor that may enhance the rigidity of dish 12 is the presence of ribs 24, shown in FIG. 1 as a radial pattern, but other patterns are also utilized. Ribs 24 add resiliency and strength to dish 12 and they extend from the back, convex side 22 of dish 12. Typically, ribs 24 may be formed in the same molding process that creates dish 12. Threaded studs 26 or other fasteners are utilized to provide structural support in the mounting process. Although threaded studs 26 are described herein, other fasteners are also contemplated, and can be generally thought of as mounting protrusions 26.

Figure 2:
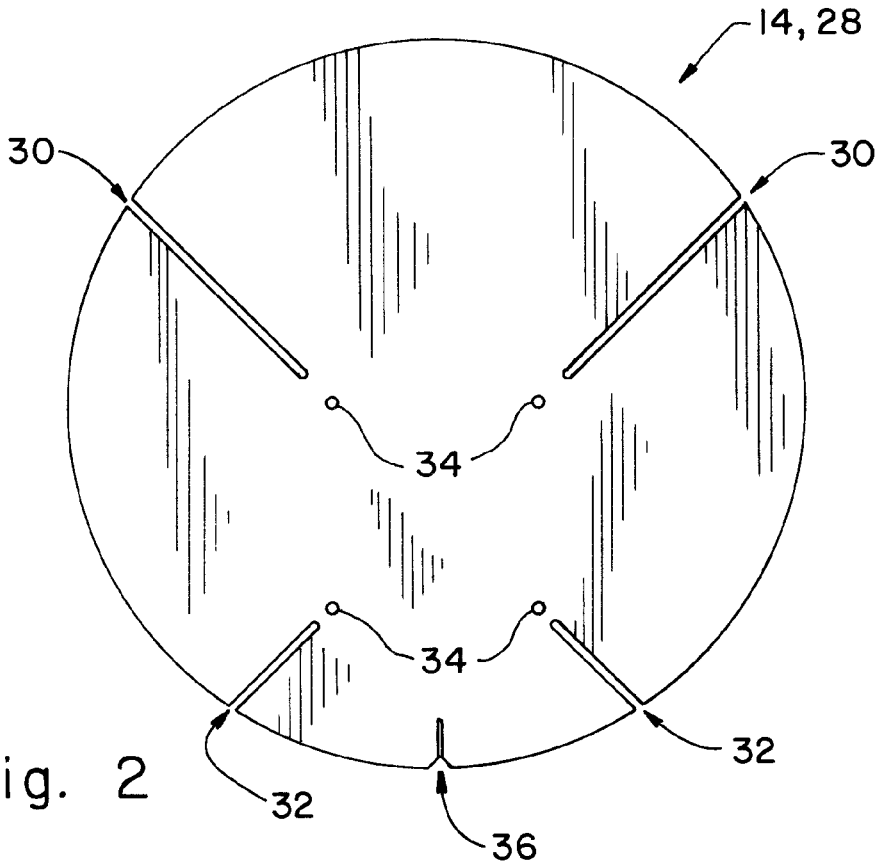
FIG. 2 illustrates a portion of the shaped plate, in its flat condition, utilized in the heating system of FIG. 1.
Figure 3:
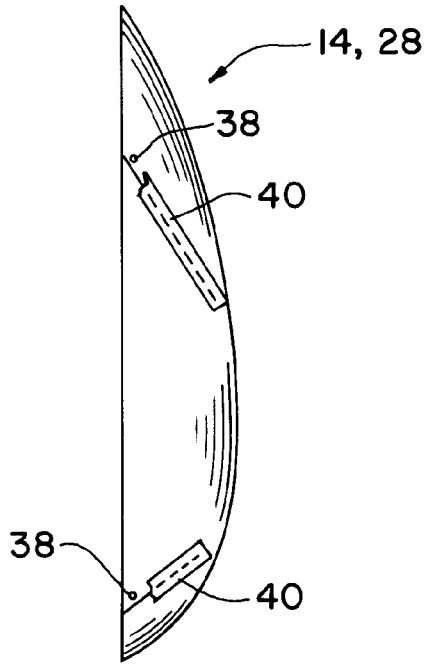
FIG. 3 is a side view of the shaped plate of FIGS. 1 and 2.
Figure 4:
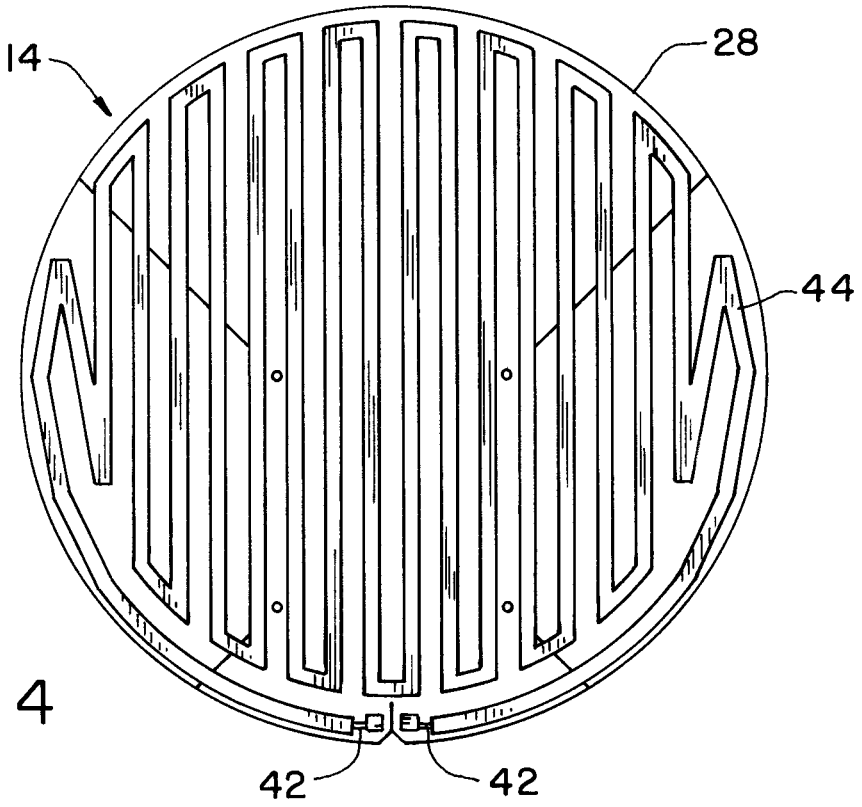
FIG. 4 is a view of the shaped plate with a heating element applied thereon and utilized in FIGS. 1-3; and, FIG. 5 is a perspective assembled view of the antenna heating system of the present invention illustrated in FIGS. 1-4.
Figure 5:
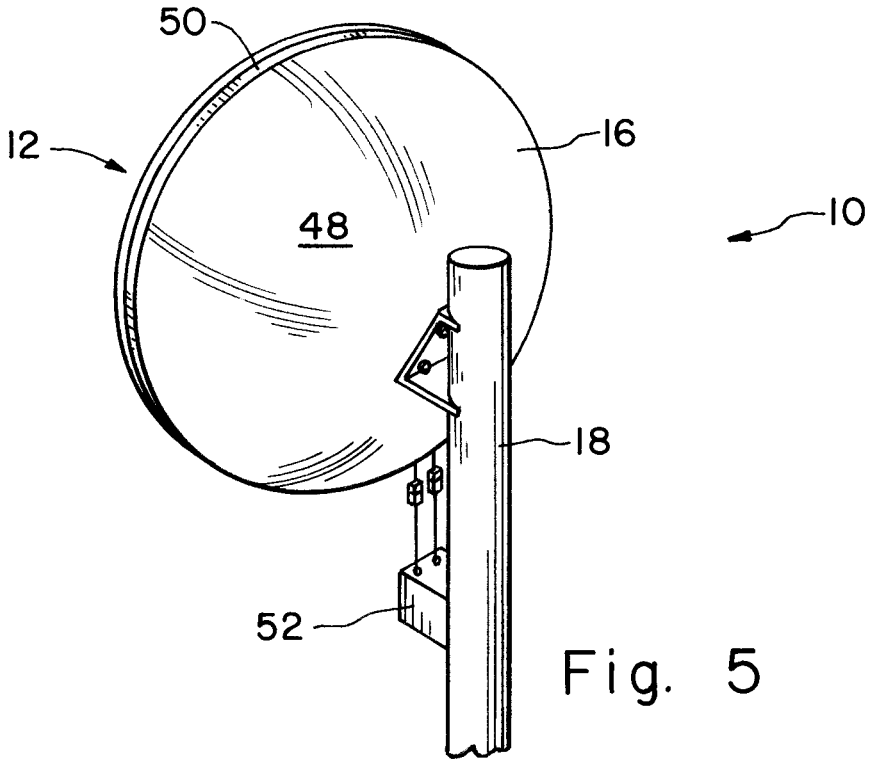

Shaped plate 14 includes a generally flat plate 28 that has slots 30 and 32 cut therein. Although four slots are illustrated in FIG. 2, other numbers of slots are contemplated. Slots 30 and 32 may be of unequal lengths so that the edges along the slots may be overlapped, as shown in FIG. 3 providing a shape that is similar to the shape of dish 12 having a circumferential edge that coincides with an edge of dish 12 that is thermally sealed at the edges. Plate 28 additionally has holes 34 so that threaded studs 26 may pass therethrough allowing dish 12 to be mounted to post 18, to which dish 12 may have been previously mounted. The combination of shaped plate 14 with insulating layer 16 and the heating elements therein can be considered a heating system for antenna system 10. Plate 28 additionally has a wiring slot 36 allowing the passage of electrical conductors that are connected to the heating element. Fasteners 38 may be utilized to secure the shaped overlaps of slots 30 and 32 with tape 40 applied over the length of the slots for sealing and further structural integrity.

Heating element 42 is applied to an inner surface of shaped plate 14 in the concave portion having tape 44 applied thereover. Tape 44 and heating element 42 can be provided in kit form so that plate 28 may be shipped in a flat condition and taped on site with heating element 42 being applied to the concave surface of shaped plate 14 formed from plate 28.

Insulating layer 16 includes a thermal reflecting layer 46 and a thermal insulating layer 48. Reflecting layer 46 can be applied to the convex portion of shaped plate 14 and insulating layer 16 is secured to shaped plate 14 by way of tape 50. Tape 50 may be applied to hold insulating layer 16 and shaped plate 14 to dish 12 along coinciding or substantially coinciding edges. Tape 50 provides a sealing of the edges to prevent passage of air into the internal cavity construct formed between shaped plate 14 and dish 12.

The shape of shaped plate 14 has a circumference that generally corresponds to the circumference of dish 12 but has a slightly larger curvature to allow for protrusion of ribs 24 and to provide an air cavity that is not sectioned by the presence of ribs 24. Even if ribs 24 are in contact with tape 44 and portions of the inner surface of shaped plate 14, the distribution of heating element 42 is substantially uniform to allow a uniform heating of that portion of dish 12. The transfer of heat from heating element 42 to dish 12 is substantially in a radiant manner and a convection manner rather than in conduction mode. This is primarily because shaped plate 14 only contacts dish 12 at a circumferential edge as well as at areas proximate to holes 34 and any coincidental contact, such as where portions of ribs 24 may touch a portion of shaped plate 14. This construct allows for a substantially non-conductive transfer of heat to dish 12. Since the heat is substantially transferred by convection in the cavity the heat is substantially uniformly applied to convex side 22 of dish 12.

A thermostat 52 is remotely associated with antenna system 10 to monitor the temperature of the ambient air and to provide electrical power to heating element 42 to generate heat that is then conveyed in a uniform manner to dish 12 by virtue of the air cavity between shaped plate 14 and dish 12. Thermostat 52 then provides electrical power to heating element 42 to thereby heat dish 12 whenever the ambient air temperature is likely to produce icing or snow on dish 12. Additionally, thermostat 52 may include a moisture sensor to detect the presence of moisture, which may alter the duration and amount of power provided to heating element 42.

The present invention advantageously provides a substantially uniform heat to the backside of dish 12, which is then substantially transferred by conduction through the thickness of dish 12 in a relatively uniform manner as compared to previous methods. The present invention also provides an insulative layer to enhance the tension of heat within the cavity between shaped plate 14 and dish 12.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An antenna system, comprising:

a dish having a concave shape on one side and a generally convex shape on an opposite side;

a heating element; and a shaped plate having said heating element applied to a first side of said shaped plate, said shaped plate having a second side opposite said first side, said shaped plate being coupled to said opposite side of said dish, said shaped plate being formed from a flat plate having at least one slot cut therein, each said slot having edges that are overlapped to thereby form said flat plate into said shaped plate.

2. The antenna system of claim 1, wherein said dish includes ribs positioned on said opposite side, at least one edge of said at least one slot being secured to a back of said shaped plate.

3. The antenna system of claim 2, wherein said heating element is generally not in contact with said opposite side of said dish.

4. The antenna system of claim 1, wherein said shaped plate and said dish are coupled along a generally coinciding edge of both said shaped plate and said dish.

5. The antenna system of claim 4, further comprising at least one mounting protrusion extending from said dish, said protrusion extending through said shaped plate.

6. The antenna system of claim 5, further comprising an insulating layer applied to said second side of said shaped plate.

7. The antenna system of claim 6, wherein said insulating layer has an edge that is proximately coincidental with said coinciding edge of said shaped plate and said dish.

8. The antenna system of claim 7, wherein said edges of said shaped plate and said insulating layer are adhered to an edge of said dish.

9. The antenna system of claim 8, wherein said first side of said shaped plate is generally spaced away from said opposite side of said dish defining a cavity between said shaped plate and said dish.

10. The antenna system of claim 9, further comprising a thermostatic control operatively connected to said heating element.

11. The antenna system of claim 9, wherein most of the heat from said heating element flows to said opposite side of said dish in a non-conductive manner.

12. An antenna dish heating method, comprising the steps of:

cutting a plurality of slots in a flat plate, said plate having two sides;

overlapping adjacent edges of said slots thereby forming a shaped plate;

securing at least one of said edges to one of said two sides of said shaped plate;

applying a heating element to a first side of said shaped plate, said shaped plate having an opposite second side; and coupling said shaped plate to a dish having a concave shape on one side and a generally convex shape on an opposite side, said shaped plate being on said opposite side of said dish.

13. The method of claim 12, wherein said dish includes ribs positioned on said opposite side.

14. The method of claim 13, wherein said heating element is generally not in contact with said opposite side of said dish.

15. The method of claim 12, wherein said coupling step includes coupling said shaped plate and said dish along a generally coinciding edge of both said shaped plate and said dish.

16. The method of claim 15, further comprising a step of applying an insulating layer to said second side of said shaped plate.

17. The method of claim 16, wherein said insulating layer has an edge that is proximately coincidental with said coinciding edge of said shaped plate and said dish.

18. The method of claim 17, wherein said coupling step includes a step of adhering said edges of said shaped plate and said insulating layer to said edge of said dish.

19. The method of claim 18, wherein said first side of said shaped plate is generally spaced away from said opposite side of said dish defining a cavity between said shaped plate and said dish.

20. The method of claim 19, wherein further comprising the step of non-conductively heating said opposite side of said dish by said heating element.

* * * * *